US011214988B2

(12) United States Patent
Fan et al.

(10) Patent No.: US 11,214,988 B2
(45) Date of Patent: Jan. 4, 2022

(54) PADLOCK FOR SECURING A SWITCH

(71) Applicant: ABUS August Bremicker Soehne KG, Wetter-Volmarstein (DE)

(72) Inventors: Wai Kuen Fan, Kowloon (HK); Bernhard Garthe, Gevelsberg (DE); Manuel Thomas, Schwelm (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 330 days.

(21) Appl. No.: 16/391,177

(22) Filed: Apr. 22, 2019

(65) Prior Publication Data

US 2019/0323268 A1 Oct. 24, 2019

(30) Foreign Application Priority Data

Apr. 23, 2018 (DE) ..... 102018109746.8

(51) Int. Cl.
*E05B 67/24* (2006.01)
*E05B 27/00* (2006.01)
(Continued)

(52) U.S. Cl.
CPC ..... *E05B 67/24* (2013.01); *E05B 27/0017* (2013.01)

(58) Field of Classification Search
CPC .. E05B 67/24; E05B 27/0017; E05B 27/0071; E05B 27/0042; E05B 2015/1664;
(Continued)

(56) References Cited

U.S. PATENT DOCUMENTS 3,171,908 A 3/1965 Malota
3,531,959 A * 10/1970 Weber ..... E05B 27/0042 70/493
(Continued)

FOREIGN PATENT DOCUMENTS

CN 2713087 Y 7/2005
CN 102031905 A 4/2011
(Continued)

OTHER PUBLICATIONS

German search report dated Feb. 11, 2019 in corresponding German patent application No. 10 2018 109 746.8 (six pages).
(Continued)

*Primary Examiner* — Lloyd A Gall
(74) *Attorney, Agent, or Firm* — Kilpatrick Townsend & Stockton LLP

(57) ABSTRACT

A lockout padlock for securing a switch of an industrial plant comprises a lock housing composed of plastic, a hoop, a lock cylinder that has a cylinder housing and a rotatable cylinder core, and a key, with the cylinder core being rotatable between a locked position in which the hoop is locked or lockable to the lock housing and an unlocked position. The lock cylinder has a plurality of tumblers, with each tumbler being movable between a respective release position and a respective blocking position. The plurality of tumblers comprise a plurality of pin tumblers that are spring-loaded in the direction of their respective blocking positions. The plurality of tumblers furthermore comprise a plurality of supplementary tumblers that are not spring-loaded and that are freely movably supported between their respective release positions and their respective blocking positions.

13 Claims, 4 Drawing Sheets

(51) Int. Cl.
*E05B 15/16* (2006.01)
*E05B 67/02* (2006.01)
*E05B 19/00* (2006.01)

(58) Field of Classification Search
CPC ..... E05B 67/02; E05B 67/00; E05B 27/0057; E05B 19/0017
USPC ..... 70/38 A, 358, 419, 421, 493–496, 70/DIG. 30, DIG. 37
See application file for complete search history.

(56) References Cited

U.S. PATENT DOCUMENTS 3,742,744 A * 7/1973 Lumme ..... E05B 27/0042 70/358
3,974,670 A * 8/1976 Wolter ..... E05B 19/0035 70/493
4,116,025 A 9/1978 Wolter
4,608,842 A * 9/1986 Tietz ..... E05B 19/0017 70/358
5,449,867 A 9/1995 Kelaita, Jr. et al.
5,755,121 A 5/1998 Crass
5,797,287 A * 8/1998 Prunbauer ..... E05B 27/0042 70/409
5,819,560 A 10/1998 Grahovec et al.
6,425,274 B1 * 7/2002 Laitala ..... E05B 67/24 70/279.1
6,490,898 B1 * 12/2002 Mottura ..... E05B 27/0039 70/495
7,278,283 B2 10/2007 Meckbach
8,245,547 B1 * 8/2012 Garthe ..... E05B 67/24 70/38 A
8,677,791 B2 * 3/2014 Piotrowski ..... E05B 27/0042 70/421
9,200,473 B2 * 12/2015 Fan ..... E05B 27/005
2005/0235709 A1 10/2005 Meckbach
2009/0272161 A1 * 11/2009 Talamonti ..... E05B 27/0042 70/491
2010/0300165 A1 12/2010 Fan et al.
2011/0252846 A1 * 10/2011 Hertel ..... E05B 27/0021 70/493
2012/0186308 A1 7/2012 Garthe
2012/0192599 A1 8/2012 Garthe
2014/0311196 A1 10/2014 Garthe et al.
2016/0060907 A1 3/2016 Tsui

FOREIGN PATENT DOCUMENTS

CN 203188702 U 9/2013
CN 103493162 A 1/2014
CN 103850533 A 6/2014
CN 203742277 U 7/2014
CN 104153649 A 11/2014
DE 2658495 A1 6/1978
DE 10 2011 009 591 A1 8/2012
DE 20 2006 021 147 U1 3/2013

OTHER PUBLICATIONS

European Search Report dated Sep. 10, 2019 in corresponding European patent application No. 19167803.6 (five pages).
Chinese Office Action dated May 25, 2021 in related Chinese Patent Application No. 201910326806.2 (six pages).

* cited by examiner

PADLOCK FOR SECURING A SWITCH

This application claims priority to German Patent Application No. 102018109746.8, filed Apr. 23, 2018, the disclosure of which is incorporated by reference herein.

The invention relates to a padlock for securing a switch of an industrial plant, in particular a so-called lockout padlock.

A particular area of application of a padlock is in the field of occupational safety. For the service of an industrial plant, for example a production machine, a part of the plant or the total plant has to be shut down. There is the risk here that the part of the industrial plant deactivated for the purposes of servicing work is accidentally reactivated while the servicing work is still continuing. A substantial danger for the service engineer can result from this. It is therefore customary that the service engineer moves a switch associated with the industrial plant or with the shut down part to an OFF position for the duration of the service work and secures it in this position, i.e. the switch is directly blocked or access to the switch is blocked. The named switch is typically an energy supply switch, for example a main electrical switch of a control device or of an energy supply device of the industrial plant.

In order to effectively avoid an accidental activation of the industrial plant by another person, each service engineer hangs a padlock on the named switch or on a blocking device associated with the switch before starting his work and locks said padlock. The switch is hereby secured in its OFF position, i.e. the switch cannot be moved accidentally back into an ON position by another person. When the service engineer has ended his work, he unlocks the padlock again and releases it from the switch. A separate individual padlock is typically associated with each service engineer.

This procedure is also called a lockout: The padlock used is accordingly called a lockout lock. The document U.S. Pat. No. 5,449,867 A shows such a securing of an electric rocker switch by means of a padlock. It is known from the document U.S. Pat. No. 3,171,908 A to secure the position of a rotary switch by means of a padlock.

It is known in connection with such a securing of a switch of an industrial plant to equip the lockout padlock used with a lock housing that is formed at least partly from plastic, with a hoop being displaceably held at the lock housing and with a lock cylinder being arranged in the lock housing that has a cylinder housing and a cylinder core rotatable about a cylinder axis in the cylinder housing. The padlock furthermore has a key by means of which the cylinder core is rotatable between a locked position and an unlocked position. In the locked position, the hoop is locked or lockable to the lock housing, in particular in a closed position of the hoop, for example after the hoop has been hung into an eyelet of the switch. In the unlocked position, the hoop is released for an opening movement relative to the lock housing, for example to be able to remove the hoop from the eyelet of the switch.

By forming the lock housing from plastic, a particularly light padlock results with sufficient mechanical stability, which is of advantage in the use as a lockout padlock since the service engineers occasionally carry a plurality of lockout locks simultaneously. A housing of plastic can also contribute to a desired electrical insulation. By the use of a plastic housing, there is furthermore a particularly simple possibility of color marking the padlock.

The smaller stability of a plastic housing in comparison with a lock housing composed of metal does not in contrast represent any serous disadvantage in a lockout padlock since the padlock only serves the purpose of securing a switch against unintentional actuation, but not, for example, as theft protection. A lockout padlock is namely anyway typically used in an environment to which unauthorized persons have no access (e.g. secured factory site). For this reason, a relatively simple locking mechanism can also be provided for the lockout padlock, in particular a simple lock cylinder. In this respect, the lock cylinder can have a plurality of tumblers that are movable between a release position and a blocking position to block the cylinder core relative to the cylinder housing when the cylinder core is in its locked position. The tumblers can be formed by pin tumblers that are spring-loaded in the direction of their blocking positions, with the pin tumblers being able to be moved against their preload by introducing the associated key into the lock cylinder such that a separation surface between the cylinder housing and the cylinder core is no longer blocked by the pin tumblers.

Such a lockout padlock having a housing composed of plastic and having a simple locking mechanism is known, for example, from the documents U.S. Pat. Nos. 7,278,283 A, 5,755,121 A and US 2012/0186308 A1.

Under rough environmental conditions, in particular when the industrial plant is only shut down in parts, a problematic mechanical effect on the lockout padlock can, however, occur, for example due to vibrations that are, for instance, caused by a production machine and that are transmitted to the switch at which the lockout padlock is fastened or hung in.

It is an object of the invention to provide a lockout padlock that enables a reliable securing of a switch of an industrial plant.

This object is satisfied by a padlock wherein the lock cylinder of the lockout padlock has a plurality of tumblers, with each tumbler being movable between a respective release position in which the tumbler releases the cylinder core for a rotation into its unlocked position and a respective blocking position in which the tumbler blocks the cylinder core in its locked position relative to the cylinder housing, with the plurality of tumblers comprising a plurality of pin tumblers that are spring-loaded in their respective blocking positions, and with the plurality of tumblers furthermore comprising a plurality of supplementary tumblers that are not spring-loaded and that are freely movably supported between their respective release position and their respective blocking position.

The lockout padlock in accordance with the invention thus has a lock cylinder that comprises a combination of spring-loaded pin tumblers and non-spring loaded, freely movable supplementary tumblers. The spring-loaded pin tumblers block the cylinder core against a rotational movement relative to the cylinder housing when said cylinder core is in its locked position. A sufficient blocking effect is hereby already achieved under normal environmental conditions. In addition, however, a plurality of supplementary tumblers are provided that are freely movably supported in the lock cylinder. Unlike the pin tumblers, the supplementary tumblers are not spring-loaded and thus demonstrate a different kinematic behavior than the spring-loaded pin tumblers under the effect of strong mechanical vibrations or vibrations of different frequencies that are possibly transmitted from the environment of the padlock onto the hung-in padlock.

The supplementary tumblers are not absolutely necessary for the purposes of theft protection in the application as a lockout padlock since a lockout padlock, as initially explained, is anyway typically used in an environment to which unauthorized third parties do not have access. The supplementary tumblers can, however, effect an additional protection against an unintentional opening of the lockout padlock.

It is conceivable in this regard with respect to the pin tumblers that the pin tumblers can be unintentionally accelerated and moved by strong vibrations introduced from outside due to their spring preload, in particular in a resonant frequency range that depends on the spring characteristics and on the mass of the respective pin tumbler to be moved. The supplementary tumblers, in contrast, can already be moved by relatively weak vibrations between their respective blocking positions and release positions due to their free movability, whereby the supplementary tumblers start to move or to "jump" between their respective blocking positions and release positions in accordance with a non-uniform pattern earlier than the pin tumblers when vibrations occur. Since a plurality of supplementary tumblers are provided, the likelihood is reduced that the supplementary tumblers all adopt the same position on strong vibrations (even if the pin tumblers are accelerated against their spring preload).

It is thus reliably prevented with the lockout padlock in accordance with the invention that the lock cylinder is unintentionally released even with unusually strong mechanical vibrations or with vibrations in a resonant range of the pin tumblers that could be transmitted from the fastening environment of the lockout padlock onto the lock cylinder. It can hereby be precluded with even greater reliability than before that all the tumblers are accelerated and moved at a specific point in time without the presence of the associated key such that the separation surface between the cylinder housing and the cylinder core is temporarily no longer blocked even when unusual vibrations or other shocks occur in the fastening environment of the lockout padlock.

Possible embodiments of the invention will be explained in the following, with these embodiments also advantageously being able to be combined with one another.

In accordance with an embodiment, the supplementary tumblers are cylindrical or substantially cylindrical, with the supplementary tumblers in particular being able to have a shape stepped along their longitudinal extent (such as a peripheral restriction) and/or chamfered ends (such as a conical or frustoconical shape). The supplementary tumblers can be particularly easily supported in a freely movable manner by a cylindrical shape so that the supplementary tumblers react to the influence of vibrations in a non-uniform manner.

In accordance with an embodiment, the freely movable supplementary tumblers are each formed in one part. It can hereby also be achieved that the supplementary tumblers demonstrate a different response behavior to vibrations introduced from the outside than the pin tumblers that are typically formed in two parts.

In accordance with an embodiment, the supplementary tumblers are designed as shorter than the pin tumblers along their respective directions of movement. It can hereby be achieved that the mass of the respective supplementary tumbler is smaller than the mass of a respective pin tumbler, whereby it is in turn effected that the supplementary tumblers demonstrate a different response behavior to vibrations introduced from the outside than the pin tumblers, in particular when the respective diameter of the supplementary tumblers is selected similar to the respective diameter of the pin tumblers.

In accordance with an embodiment, the supplementary tumblers are supported in the rotatable cylinder core, with the supplementary tumblers engaging in their respective blocking positions into a blocking recess at an inner periphery of the cylinder housing. Since the respective supplementary tumbler is supported in the cylinder core since its end only engages into an associated blocking recess of the cylinder housing in its blocking position, a particularly smooth support of the freely movable supplementary tumblers is ensured.

In this respect, the blocking recess provided at the inner periphery of the cylinder housing can extend along a limited peripheral angle with respect to the direction of rotation of the cylinder core, said peripheral angle substantially corresponding to the width of the respective supplementary tumbler, i.e. apart from production tolerances and a certain movement play, the respective supplementary tumbler is seated in an almost shape-matched manner with respect to the direction of rotation of the cylinder core in the blocking recess. In this respect, the blocking recess can be bounded in the direction of rotation of the cylinder core by at least one guide chamfer. It is hereby effected that on a deliberate rotational drive of the cylinder core by means of the associated key, the supplementary tumbler in its blocking position is raised or led out of the blocking recess of the cylinder housing along the respective guide chamfer. The respective blocking recess of the cylinder housing can also be bounded at both sides with respect to the direction of rotation of the cylinder core by a respective guide chamfer.

In accordance with an embodiment, the supplementary tumblers of the lock cylinder are translationally, i.e. linearly, movable.

In accordance with an embodiment, the supplementary tumblers are movable within a respective plane that is perpendicular to the cylinder axis. A movability of the supplementary tumblers along the cylinder axis is in contrast not absolutely necessary since vibrations of the lock cylinder that extend along the cylinder axis do not effect the risk of an unintentional release of the cylinder core to the same degree as vibrations that extend perpendicular to the cylinder axis.

In accordance with an embodiment, the supplementary tumblers of the lock cylinder can be arranged behind one another, in particular aligned with one another, along the cylinder axis.

In accordance with an embodiment, the supplementary tumblers of the lock cylinder are movably supported in a radial direction with respect to the cylinder axis or offset in parallel with a radial direction.

In accordance with an embodiment, the hoop extends within a plane of extent. The hoop can in particular have a first limb and a second limb that extends in parallel with the first limb, with the two limbs extending within said plane of extent of the hoop or defining the plane of extent of the hoop. With such an embodiment, the direction in which the supplementary tumblers are movable can extend at an angle different from zero to the plane of extent of the hoop. Said angle can in particular be an acute angle. In other words, the direction of movability of the supplementary tumblers can extend obliquely to the plane of extent of the hoop. It can hereby be achieved that vibrations of the lockout padlock that are introduced onto the lock cylinder from the fastening environment of the lockout padlock via the hoop generally extend in a different direction than the direction of movability of the supplementary tumblers. The supplementary tumblers hereby tend less to be accelerated or moved away out of their respective blocking positions by such vibrations. A corresponding arrangement can be provided for the pin tumblers (direction of movability of the pin tumblers extends obliquely to the plane of extent of the hoop).

In accordance with an embodiment, the direction of movement of the pin tumblers and the direction of movement of the supplementary tumblers extend in parallel with one another or at an angle different from zero. For example, the direction of movement of the pin tumblers and the direction of movement of the supplementary tumblers can extend, viewed in a projection along the cylinder axis at angle to one another of 20°, 30°, 45°, 60°, 75°, 105°, 120°, 135°, 150°, 165°, 180°, or at an intermediate value thereof.

In accordance with an embodiment, the pin tumblers of the lock cylinder are arranged behind one another along the cylinder axis.

In accordance with an embodiment, the pin tumblers of the lock cylinder are translationally, i.e. linearly, movable.

In accordance with an embodiment, the pin tumblers of the lock cylinder are spring-loaded in a radial direction with respect to the cylinder axis or offset in parallel with a radial direction.

In accordance with an embodiment, the pin tumblers are cylindrical or substantially cylindrical, with the pin tumblers in particular being able to have a shape stepped along their longitudinal extent (such as a peripheral restriction) and/or chamfered ends (such as a conical or frustoconical shape).

In accordance with an embodiment, the pin tumblers of the lock cylinder each have a housing pin and a core pin, with the housing pin being substantially supported in the cylinder housing and the core pin being substantially supported in the cylinder core. If the respective separation point between the housing pin and the core pin of the pin tumblers is disposed on the separation surface between the cylinder housing and the cylinder core and if the supplementary tumblers also do not block the cylinder core, the cylinder core can be rotated into the unlocked position.

In accordance with an embodiment, a respective compression spring that spring-loads the pin tumbler in the direction of its blocking position is associated with each pin tumbler.

In accordance with an embodiment, the lock cylinder has at least one further supplementary tumbler to block the cylinder core relative to the cylinder housing in the locked position, with the further supplementary tumbler being freely movably supported along a different direction than said plurality of supplementary tumblers.

In accordance with an embodiment, the key has a shaft whose cross-section has a longitudinal shape having two broad sides and two narrow sides, with a plurality of primary coding being provided at each broad side and being associated with the pin tumblers and/or with a plurality of secondary coding sections being provided at each broad side and/or at each narrow side and being associated with the supplementary tumblers. The primary or secondary coding sections can be configured as recesses or as elevated portions. If the key is introduced into the lock cylinder, the respective primary coding section of the key can cooperate with an associated pin tumbler of the lock cylinder such that the associated pin tumbler is moved into its release position to release the cylinder core for a rotational movement into the unlocked position. If the key is introduced into the lock cylinder, the respective secondary coding section of the key can also cooperate with an associated supplementary tumbler of the lock cylinder such that the associated supplementary tumbler is moved into its release position to release the cylinder core for a rotational movement into the unlocked position. An accommodation of the pin tumblers and of the supplementary tumblers in the lock cylinder is possible in a particularly simple manner by the use of such a key having two broad sides and two narrow sides of the key shaft. The key can in particular be of the type of a dimple pin key.

The primary coding sections and the secondary coding sections can be arranged at the key shaft, in particular in a rotationally symmetrical manner (with respect to a rotation of the key shaft by 180° about its longitudinal axis). In such an embodiment, the key can be introduced into the lock cylinder in two possible rotational positions.

In accordance with an embodiment, the cylinder housing has a hollow cylinder section and a web section extending radially from the hollow cylinder section. Parts of the pin tumblers can in particular be supported in the web section. The cylinder core can have a keyway that has an elongate cross-sectional shape having a long side and a short side, with the long side extending perpendicular to the radial direction of extent of the web section. This embodiment is particularly suitable for the primary coding sections to be arranged at the broad sides of the key shaft. The pin tumblers do not in this respect absolutely have to extend in a center plane of the lock cylinder, but can rather also be arranged laterally offset therefrom.

In accordance with an embodiment, the padlock has at least one latch that locks the hoop to the lock housing in the locked position of the cylinder core. Two latches can in particular be provided that each lock a hoop limb and/or that are movable in opposite senses to one another. The respective latch can be formed by a locking ball.

In accordance with an embodiment, the padlock has a rotatable entrainer that is coupled to the cylinder core and that drives the latch or latches. An automatic function can be provided in this respect in which the hoop is lockable to the lock housing by a complete introduction into the lock housing while the cylinder core is in the locked position. The entrainer can be preloaded for this purpose, for example into a locked position, with the entrainer being temporarily rotated in the direction of an unlocked position by the complete introduction of the hoop into the lock housing by means of the latch or latches. An automatic function can also be implemented in that the latch or latches is or are preloaded in the direction of its or their locked position or positions. Alternatively to this, a compulsory guidance can be provided in which the entrainer is rotationally fixedly coupled to the cylinder core and in which the latch or latches is or are also in a forced coupling with the entrainer.

In accordance with an embodiment, the lock housing is designed in multiple parts, with at least one housing part being formed from plastic. A base part can in this respect, for example, be formed from plastic or from metal.

In accordance with an embodiment, at least one of the elements of hoop, covering of the hoop, latch, or entrainer is formed from an electrically insulating material, in particular from plastic or from ceramics. A more extensive electrical insulation can hereby be effected for the use as a lockout padlock.

In accordance with an embodiment, the hoop is substantially of a U shape with a first limb and a second limb that extends in parallel with the first limb and is longer than the first limb. The second limb can serve to fasten the hoop permanently to the lock housing, with the hoop nevertheless being able to be movable in its open position.

In accordance with an embodiment, the hoop can adopt a closed position in which the hoop is closed and is locked to the lock housing. The hoop can furthermore adopt an open position in which the hoop is open and is movable, in particular rotationally movable, relative to the lock housing.

In accordance with an embodiment, the opening movement of the hoop relative to the lock housing is a translatory movement.

In accordance with an embodiment, the cylinder axis extends in parallel with the direction of the opening movement of the hoop and/or with the direction of extent of the hoop and/or with the direction of extent of the limbs of the hoop.

The invention will be explained in the following only by way of example with reference to the drawings. Elements which are the same or of the same kind are marked by the same reference numerals therein.

Figure 1:
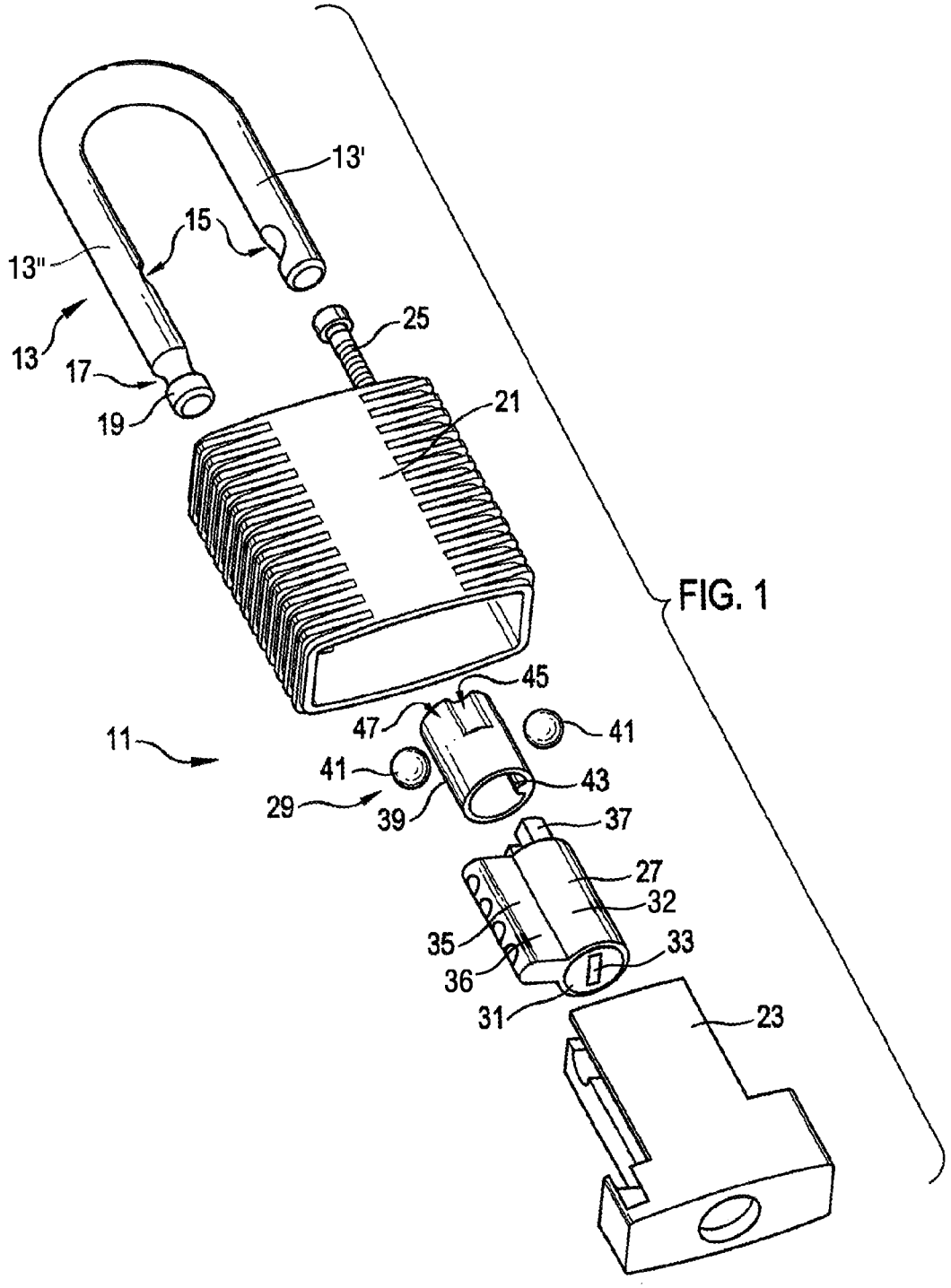
FIG. 1 shows a lockout padlock in an exploded view.

The padlock shown in FIG. 1 has a lock body 11 and a hoop 13. The hoop 13 has a U shape with one shorter limb 13' and one longer limb 13". An inwardly directed locking cutout 15 is formed at both limbs 13', 13" of the hoop 13. Furthermore, a ring groove 17 with an abutment head 19 adjacent to it is provided at the free end of the longer limb 13".

The lock body 11 has a lock housing that has an outer housing 21 and an inner housing 23. The outer housing 21 and the inner housing 23 comprise plastic. The inner housing 23 can be pushed into the outer housing 21 and can be fixed to the outer housing 21 by means of a securing screw 25. The outer housing 21 and the inner housing 23 accommodate a lock cylinder 27 and a locking mechanism 29 via which the lock cylinder 27 cooperates with the hoop 13.

The lock cylinder 27 has a cylinder core 31 having a keyway 33. The cylinder core 31 is rotatably mounted within a hollow cylinder section 32 of a cylinder housing 35 with respect to a cylinder axis A (FIG. 2), wherein a rotary actuation should only be possible when an associated key 55 (FIG. 2) is introduced into the keyway 33. The cylinder housing 35 furthermore has a web section 36 radially extending from the hollow cylinder section 32 laterally for the pin tumblers explained in the following. The cylinder core 31 has a drive prolongation 37 at the rear side.

The locking mechanism 29 comprises an entrainer 39 and two locking balls 41. The entrainer 39 has a substantially hollow cylindrical shape with an engagement nose 43 at the inner side which enables a rotationally fixed coupling to the drive prolongation 37 of the lock cylinder 27. The entrainer 39 has two receiving cutouts 45 at its outer side which can partly accept the locking balls 41 on an unlocking actuation of the lock cylinder 27 and thus of the entrainer 39. At the periphery, in each case adjacent to the receiving cutouts 45, the entrainer 39 forms locking sections 47 by which the locking balls 41 can be held in locking engagement with the locking cutouts 15 of the hoop 13.

Figure 2:
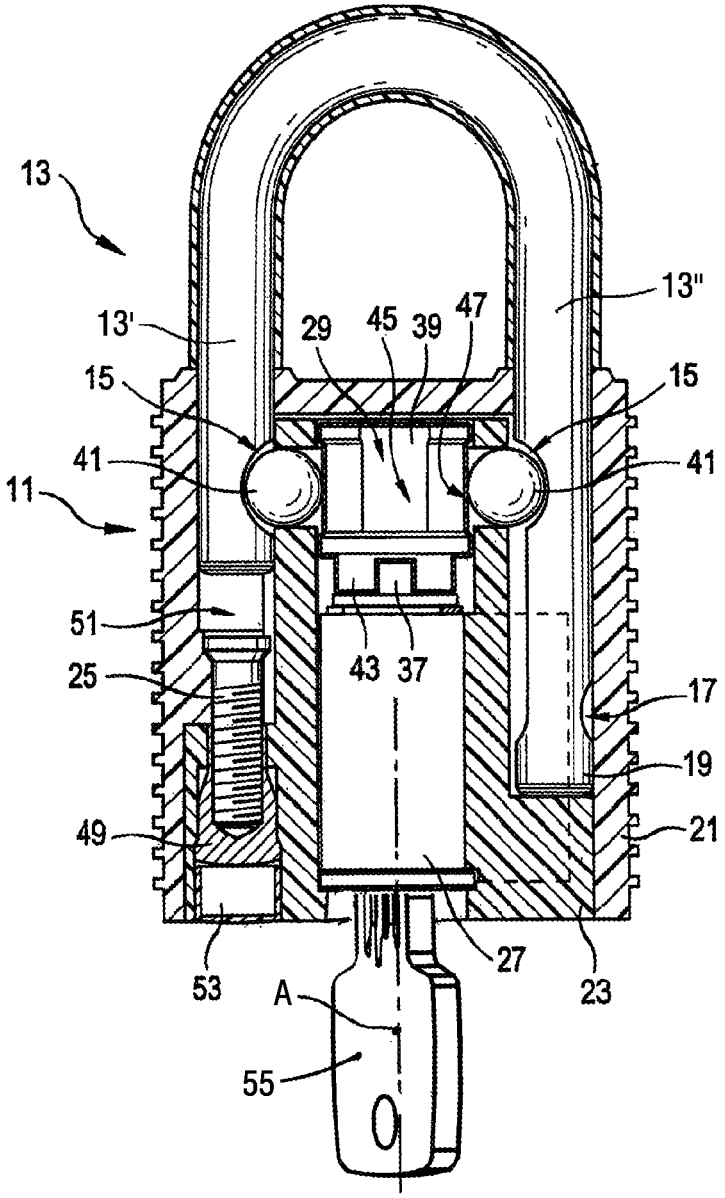
FIG. 2 shows a lockout padlock in an longitudinal sectional view.

As regards the mutual fastening of the outer housing 21 and the inner housing 23, FIG. 2 additionally shows that the fastening screw 25 can cooperate with a nut 49 rotationally fixedly inserted into the inner housing 23. The fastening screw 25 is inserted into a hoop receiving passage 51 of the outer housing 21 which is closed by the hoop 13 when the hoop 13 is locked to the lock body 11—as shown in FIG. 2. The nut 49 is covered by means of a cover 53. Provided that the lock cylinder 27 has been brought into the open position and the shorter limb 13' of the hoop 13 has been removed from the hoop receiving passage 51, the securing screw 25 can again be released from the nut 49 to remove the inner housing 23 from the outer housing 21.

The padlock shown in FIGS. 1 and 2 selectively allows the locking of the hoop 13 to the lock body 11 in its closed position (locked position of the cylinder core 31) or the release of the shorter limb 13' of the hoop 13 from the lock body 11 (unlocked position of the cylinder core 31) by a corresponding actuation of the lock cylinder 27, for example to be able to introduce the hoop 13 into an eyelet of a switch or to remove it therefrom in its open position. The padlock shown is in particular suitable for use as a lockout padlock.

FIG. 2 shows a state of the padlock in which the hoop 13 is locked and is thus secured against removal from the lock body 11. The locking sections 47 of the entrainer 39 hold the locking balls 41 in locking engagement with the locking cutouts 15 of the hoop 13 for this purpose. To unlock the padlock, a rotational unlocking actuation by means of an associated key 55 is required. The drive prolongation 37 of the cylinder core 31 and the entrainer 39 are hereby rotated by 90° so that a respective receiving cutout 45 of the entrainer 39 is rotated into the region of the locking balls 41. The locking balls 41 can thus move back out of the locking cutouts 15 of the hoop 13. The hoop 13 can now be pulled out of the lock body 11 axially until the abutment head 19 of the longer hoop limb 13" abuts the respective locking ball 41. The shorter limb 13' of the hoop 13 now already projects out of the lock body 11. The hoop 13 can now be rotated about the longitudinal axis of the longer hoop limb 13". A repeated locking of the hoop 13 to the lock body 11 takes place in the reverse order.

Figure 3:
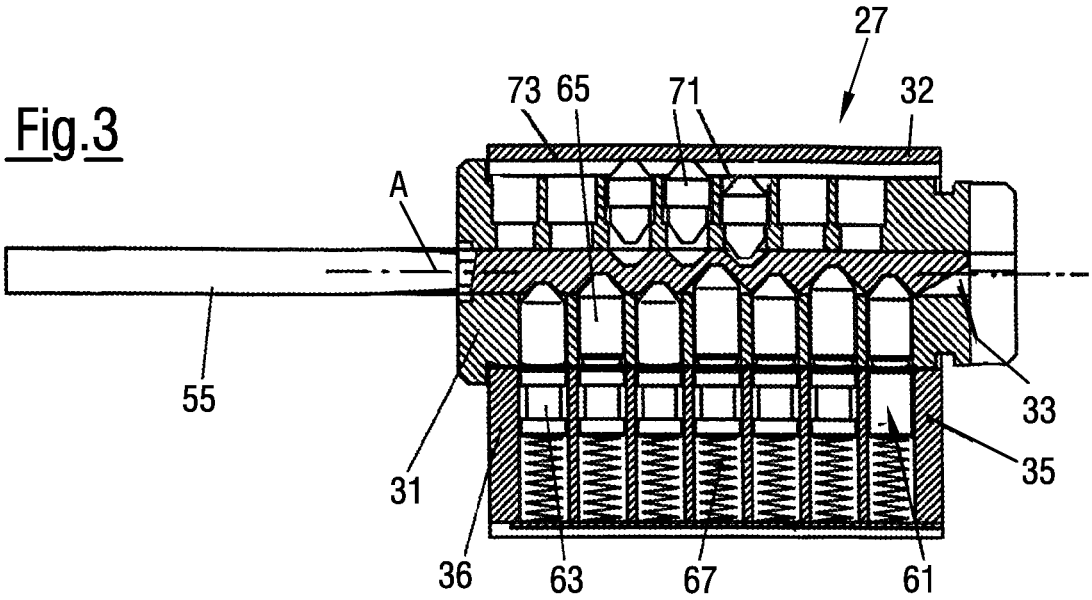
FIG. 3 shows a lock cylinder in a longitudinal sectional view.

FIG. 3 shows a possible embodiment of the lock cylinder 27 of the lockout padlock in accordance with FIGS. 1 and 2 in a longitudinal section, with the associated key 55 being introduced into the keyway 33 of the cylinder core 31. The lock cylinder 27 has a plurality of pin tumblers 61 that are arranged behind one another along the cylinder axis A and that block the cylinder core 31 against a rotational movement relative to the cylinder housing 35 in their respective blocking positions. The pin tumblers 61 are movable in a vertical direction with respect to the representation in accordance with FIG. 3. The pin tumblers 61 each have a housing pin 63 and a core pin 65 and they are spring-loaded in the direction of their blocking positions by means of a respective compression spring 67. The pin tumblers 61 are moved against the respective spring load out of their blocking positions into release positions shown in FIG. 3 by means of the key 55 introduced into the keyway 33.

The lock cylinder 27 furthermore has a plurality of pin tumblers 71 that are arranged behind one another along the cylinder axis A and that likewise block the cylinder core 31 against a rotational movement relative to the cylinder housing 35 in their respective blocking positions. The supplementary tumblers 71—unlike the pin tumblers 61—are not spring-loaded, but are rather freely movably supported in the cylinder core 31 between their release positions and their blocking positions. In the embodiment shown, the supplementary tumblers 71 are likewise movable in a vertical direction with respect to the representation in accordance with FIG. 3. The supplementary tumblers 71 are formed in one part and are relatively short in comparison with the pin tumblers 61. The supplementary tumblers 71 are substantially cylindrical, with both ends having a frustoconical shape, however.

Figure 4:
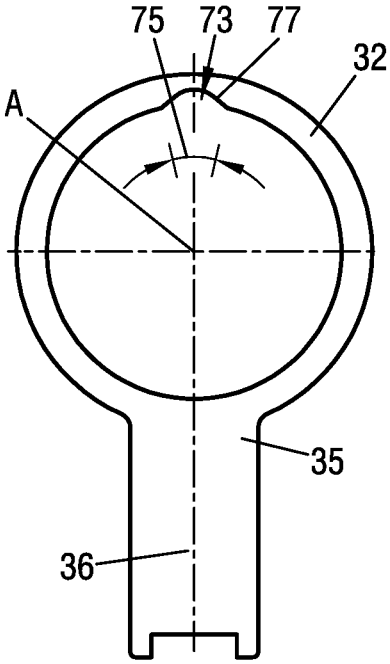
FIG. 4 shows a front view of the cylinder housing of the lock cylinder in accordance with FIG. 3.

In their blocking positions, the supplementary tumblers 71 engage into a blocking recess 73 at an inner periphery of the hollow cylinder section 32 of the cylinder housing 35. As can be seen from the front view of the cylinder housing 35 in accordance with FIG. 4, the blocking recess 73 is formed by a continuous groove that extends along the cylinder axis A at the inner periphery of the hollow cylinder section 32. In the direction of rotation of the cylinder core 31, the blocking recess 73 extends along a peripheral angle 75 at the inner periphery of the cylinder housing 35, said peripheral angle 75 substantially corresponding to the respective supplementary tumbler 71, with the blocking recess 73 being bounded at both sides by a respective guide chamfer 77 in the direction of rotation of the cylinder core 31.

Since the supplementary tumblers 71 are freely movable supported in the cylinder core 31, that is are inserted in a substantially loose manner, the supplementary tumblers 71 can be moved relatively simply between their release positions and their blocking positions in comparison with the pin tumblers 61. A movement of the respective supplementary tumbler 71 can thus already be caused—apart from the use of the key 55—by gravity or by vibrations that are introduced onto the lockout padlock from the outside and that can be effected, for instance, by vibrations or shocks of the fastening environment of the lockout padlock. The extent to which such outside effects actually result in a movement of the supplementary tumblers 71 depends on the strength and on the frequency of the introduced mechanical vibrations and on the alignment of the lockout padlock relative to the direction of gravity. Since the freely movably and relatively light supplementary tumblers 71 do not necessarily react uniformly in this respect, the supplementary tumblers 71 can adopt slightly different positions, as is shown in FIG. 3.

A lockout padlock provided with a lock cylinder 27 (FIGS. 1 and 2) in accordance with FIG. 3 is thus characterized by particularly high security against an unintentional opening, in particular with respect to mechanical vibrations that are introduced from the outside and that could arise in the fastening environment of the lockout padlock due to machine parts that have not been stopped, for instance, and that could be transmitted to the padlock hung at a switch (the key 55 is admittedly not introduced into the lock cylinder 27 in such a scenario, but is removed again). The supplementary tumblers 71, in contrast, can namely already be moved by relatively weak vibrations between their respective blocking positions and release positions due to their free movability, whereby the supplementary tumblers 71 start to move or to "jump" between their respective blocking positions and release positions in accordance with a non-uniform pattern (earlier than the spring-loaded pin tumblers 61) when vibrations occur. The risk is hereby reduced that all the tumblers 61, 71 are simultaneously accelerated and moved by an outer effect such that the separation surface between the cylinder housing 35 and the cylinder core 31 is no longer temporarily blocked.

Figure 5:
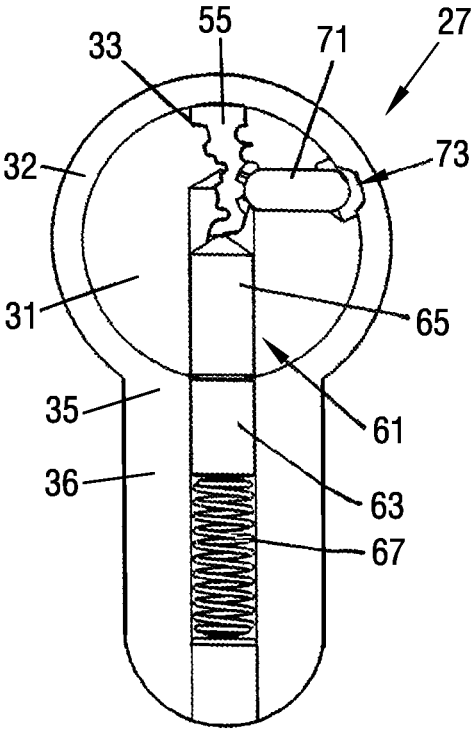
FIG. 5 shows a further lock cylinder in a cross-sectional view.

FIG. 5 shows in a cross-sectional view (sectional plane extends perpendicular to the cylinder axis A) that the supplementary tumblers 71 can (alternatively or additionally) also be freely movably supported in a horizontal direction (with respect to the representation in accordance with FIG. 5), that is in a direction perpendicular to the direction of movability of the pin tumblers 61. Different relative angles than the shown 90° angle are also possible.

Figure 6:
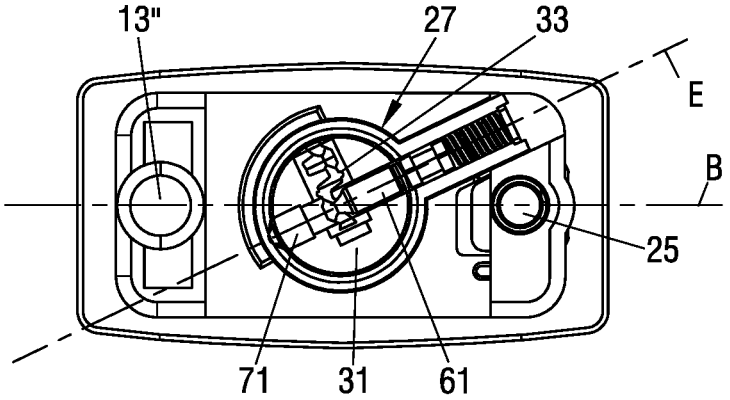
FIG. 6 shows a lockout padlock in a cross-sectional view.

FIG. 6 shows in a cross-sectional view (sectional plane extends perpendicular to the cylinder axis A) an embodiment of a lockout padlock (such as, for example, a lockout padlock in accordance with FIGS. 1 and 2). In this embodiment, the hoop 13 extends within a plane of extent B that is spanned by the two limbs 13', 13" of the hoop 13. The fastening screw 25 arranged in the axial prolongation is shown in the right region in FIG. 6 instead of the limb 13". The direction E in which the supplementary tumblers 71 are movable is furthermore shown in FIG. 6. This direction E extends at an angle different from zero to the plane of extent B of the hoop 13. An angle of approximately 20°, 25", or 30° can be provided, for example. It can hereby be achieved that vibrations that are transmitted onto the hoop 13 and thus onto the lock cylinder 27 from the outside generally extend in a different direction than the direction E of the movability of the supplementary tumblers 71.

Figure 7:
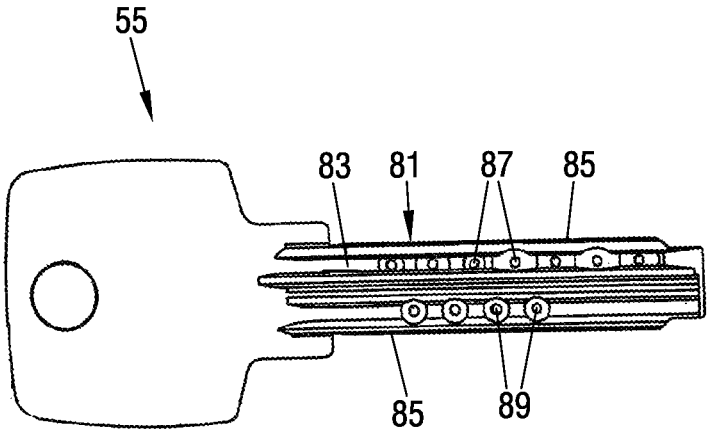
FIG. 7 shows a key in a plan view.

FIG. 7 shows a key 55 that has a key shaft 81 whose cross-section has a longitudinal shape having two broad sides 83 and two narrow sides 85. In the plan view in accordance with FIG. 7, only one of the two broad sides 83 is visible, with the other broad side 83 being of identical design. The two broad sides 83 can be profiled in a typical manner, that is can be provided with webs and grooves that extend in the longitudinal direction of the key shaft 81. A plurality of secondary coding sections 87 can be provided at each broad side 83 in the form of recesses that are associated with the pin tumblers 61 of the lock cylinder 27. A plurality of primary coding sections 89 can furthermore be provided at each broad side 83 in the form of recesses that are associated with the supplementary tumblers 71 of the lock cylinder 27. In their respective release positions the pin tumblers 61 engage into the primary coding sections 87 and the supplementary tumblers 71 engage into the secondary coding sections 89.

Figure 8:
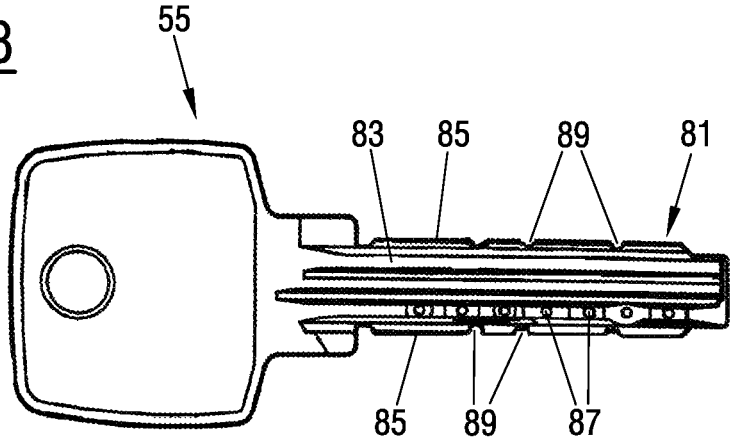
FIG. 8 shows a further key in a plan view.

FIG. 8 shows a similar key 55 whose key shaft 81 has two broad sides 83 and two narrow sides 85. A plurality of primary coding sections 87 are in turn arranged at each broad side 83 in the form of recesses for the pin tumblers 61. A plurality of secondary coding sections 89 are furthermore arranged at each narrow side 85 in the form of lateral notches for the supplementary tumblers 71.

In the respective key 55 in accordance with FIGS. 7 and 8, the primary coding sections 87 and the secondary coding sections 89 are arranged at the key shaft 81 in a rotationally symmetrical manner (with respect to a rotation of the key shaft 81 by 180° about its longitudinal axis). The keyway 33 of the associated lock cylinder 27 can have, corresponding to the cross-sectional shape of the key 55, an elongate cross-sectional shape having a long side and a short side, with the long side in particular being able to extend perpendicular to the radial direction of extent of the web section 36 of the cylinder housing 35 in accordance with FIG. 4.

REFERENCE NUMERAL LIST

11 lock body
13 hoop
13' limb
13" limb
15 locking cutout
17 ring groove
19 abutment head
21 outer housing
23 inner housing
25 securing screw
27 lock cylinder

29 locking mechanism
31 cylinder core
32 hollow cylindrical section
33 keyway
35 cylinder housing
36 web section
37 drive prolongation
39 entrainer
41 locking ball
43 engagement nose
45 receiving cutout
47 locking section
49 nut
51 hoop receiving passage
53 cover
55 key
61 pin tumbler
63 housing pin
65 core pin
67 compression spring
71 supplementary tumbler
73 blocking recess
75 peripheral angle
77 guide chamfer
81 key shaft
83 broad side of the key shaft
85 narrow side of the key shaft
87 primary coding section
89 secondary coding section
A cylinder axis
B plane of extent B of the hoop
E direction of movability of the supplementary tumblers

The invention claimed is:

1. A lockout padlock configured for securing a switch of an industrial plant, the lockout padlock comprising:

a lock housing composed of plastic;

a hoop displaceably held at the lock housing;

a lock cylinder arranged in the lock housing and comprising a cylinder housing and a cylinder core rotatable about a cylinder axis in the cylinder housing; and a key, wherein the cylinder core is rotatable by means of the key between a locked position in which the hoop is locked or lockable to the lock housing and an unlocked position in which the hoop is released for an opening movement relative to the lock housing, wherein the lock cylinder comprises a plurality of tumblers, with each tumbler being movable relative to the cylinder housing between a respective release position in which the tumbler releases the cylinder core for a rotation into its unlocked position and a respective blocking position in which the tumbler blocks the cylinder core in its locked position relative to the cylinder housing, wherein the plurality of tumblers comprise a plurality of pin tumblers that are spring-loaded in the direction of their respective blocking positions, wherein the plurality of tumblers furthermore comprise a plurality of supplementary tumblers that are not spring-loaded and are freely movably supported between their respective release position and their respective blocking position, and wherein the plurality of pin tumblers and the plurality of supplementary tumblers are configured to have different kinematic behaviors so that unintentional movement of the plurality of pin tumblers and the plurality of supplementary tumblers to the respective release positions, caused by vibration of the lockout padlock by the industrial plant, is prevented.

2. A lockout padlock in accordance with claim 1, wherein the supplementary tumblers are cylindrical or substantially cylindrical.

3. A lockout padlock in accordance with claim 1, wherein the supplementary tumblers are formed in one part.

4. A lockout padlock in accordance with claim 1, wherein the supplementary tumblers are formed as shorter than the pin tumblers along their respective directions of movement.

5. A lockout padlock in accordance with claim 1, wherein the supplementary tumblers are supported in the cylinder core and engage in their respective blocking positions into a blocking recess at an inner periphery of the cylinder housing.

6. A lockout padlock in accordance with claim 5, wherein the blocking recess extends at the inner periphery of the cylinder housing along a peripheral angle in a direction of rotation of the cylinder core, said peripheral angle substantially corresponding to the width of the respective supplementary tumbler, with the blocking recess being bounded in the direction of rotation of the cylinder core by at least one guide chamfer.

7. A lockout padlock in accordance with claim 1, wherein the supplementary tumblers are movable within a respective plane that is perpendicular to the cylinder axis.

8. A lockout padlock in accordance with claim 1, wherein the supplementary tumblers are arranged behind one another along the cylinder axis.

9. A lockout padlock in accordance with claim 1, wherein the hoop extends within a plane of extent, with the direction in which the supplementary tumblers are movable extending at an angle different from zero to the plane of extent of the hoop.

10. A lockout padlock in accordance with claim 1, wherein the direction of movement of the pin tumblers and the direction of movement of the supplementary tumblers extend in parallel with one another or at an angle different from zero.

11. A lockout padlock in accordance with claim 1, wherein the pin tumblers have a respective housing pin and a respective core pin, with the housing pin being substantially supported in the cylinder housing and the core pin being substantially supported in the cylinder core.

12. A lockout padlock in accordance with claim 1, wherein the key has a shaft whose cross-section has a longitudinal shape having two broad sides and two narrow sides, with a plurality of primary coding sections being provided at each broad side that are associated with the pin tumblers, and with a plurality of secondary coding sections being provided at each broad side and/or at each narrow side that are associated with the supplementary tumblers.

13. A lockout padlock in accordance with claim 1, wherein the cylinder housing has a hollow cylinder section and a web section extending radially from the hollow cylinder section, with the cylinder core having a keyway that has an elongate cross-sectional shape having a long side and a short side, with the long side extending perpendicular to the radial direction of extent of the web section.

* * * * *